US006428069B1

(12) United States Patent
Simonson, Jr.

(10) Patent No.: US 6,428,069 B1
(45) Date of Patent: Aug. 6, 2002

(54) PALLET PULLER ARRANGEMENT

(76) Inventor: Russell L. Simonson, Jr., 6165 Clarkston Rd., Clarkston, MI (US) 48346

( * ) Notice: Subject to any disclaimer, the term of this patent is extended or adjusted under 35 U.S.C. 154(b) by 0 days.

(21) Appl. No.: 09/720,148

(22) PCT Filed: Jun. 23, 1999

(86) PCT No.: PCT/US99/14230

§ 371 (c)(1),
(2), (4) Date: Dec. 20, 2000

(87) PCT Pub. No.: WO99/67167

PCT Pub. Date: Dec. 29, 1999

Related U.S. Application Data

(60) Provisional application No. 60/090,610, filed on Jun. 23, 1998, and provisional application No. 60/103,239, filed on Oct. 5, 1998.

(51) Int. Cl.[7] ..... B66C 1/62
(52) U.S. Cl. ..... 294/82.1
(58) Field of Search ..... 294/15, 26, 67.2, 294/82.1, 82.11, 86.4, 89; 280/24, 480

(56) References Cited

U.S. PATENT DOCUMENTS 1,941,582 A * 1/1934 Schroeder ..... 294/82.1
3,073,613 A * 1/1963 Bergstrom ..... 294/82.1
4,094,544 A * 6/1978 Spaine ..... 294/82.1
4,421,353 A * 12/1983 Smith ..... 294/82.1
5,791,711 A * 8/1998 Tobias ..... 294/82.1

* cited by examiner

*Primary Examiner*—Johnny D. Cherry
(74) *Attorney, Agent, or Firm*—Rohm & Monsanto, P.L.C.

(57) ABSTRACT

A puller device (10) for engaging with a pallet of the type having at least a bottom deck formed of a plurality of substantially parallel spaced-apart slats, such slat being fixed to the slat-coupling side of a stringer that extends substantially orthogonal to the parallel slats. The puller device has a puller portion (11) having an elongated configuration along an axial direction thereof. The puller portion has first and second ends that are distal from one another. An engagement portion (13) is fixed to the first end of the puller portion and is provided with a stringer cradling portion (14) that is fixed to the first end of the puller portion and extends transverse to the axial direction for communicating with the slat-coupling side of the stringer in the region between the spaced-apart slats. The engagement portion has a thickness that is predetermined to prevent same from being urged between the slat and the stringer. Additionally, a flange (15) is arranged to extend from the stringer cradling portion, and a coupling protuberance (16) is fixed to the flange extending substantially toward the second end of the puller portion for communication with the surface of the slat that is directed toward the slat-coupling side of the stringer. A coupler arrangement (12) is disposed on the second end of the puller portion for facilitating engagement of a rope or chain.

17 Claims, 5 Drawing Sheets

PALLET PULLER ARRANGEMENT

RELATIONSHIP TO OTHER APPLICATION

This Patent Application is a continuation-in-part of Provisional Patent Application Ser. No. 60/090,610, filed Jun. 23, 1998, and is a continuation of Provisional Patent Application Ser. No. 60/103,239 filed Oct. 5, 1998.

BACKGROUND OF THE INVENTION

1. Field of the Invention

This invention relates generally to a tool for hooking pallets or skids, and more particularly, to a pallet hook for repositioning two-way and four-way stringer pallets.

2. Description of the Art

Goods and materials arrive at, and depart from, almost every type of factory or warehouse by unit loads on material handling devices which are typically pallets. A unit load is a number of items, arranged and restrained as one unit on a support platform, so as to be moved and handled at one time, thereby reducing the number of trips required to load/unload items, and consequently reducing handling costs and product damage. In addition to facilitating the efficient handling of large quantities of materials, pallets also serve as a platform base for stacking individual items.

Conventionally, every pallet contains a top deck and bottom deck of wood slats running parallel to each other. Stringers (or runners), which are solid or notched beams running perpendicular to the slats comprising the decks, separate the two decks. In a typical two-way stringer pallet, there are three stringers. The stringers, identified by location, define two chambers between the outside stringers and the interior, or center stringer. The chambers provide the openings for the fork tines of a lift truck or hand jack. The term "two-way" indicates that the fork lift can be inserted from either the front or the back of the pallet. In a four-way pallet, the stringers are notched for entry from all four directions. Skids, of course, are pallets with only an upper, or top, deck.

It is a problem, well-known in the art, that a pallet desired to be moved may be in a location that is unreachable by a fork lift truck, or even a hand jack, because of the lack of a dock or ramp, height or width limitations, or weight restrictions. In this case, it is known to solve the problem with a winch, chain, and pallet pullers. Pallet pullers comprise, in one conventional embodiment, a pair of curved gripping heads on arms connected to each other by a pivot, or in some arrangements, a scissoring arrangement. The ends of the arms, distal to the dripping heads, are connected to each other by a short length chain. A chain attached to the winch of a fork lift is then attached to the connecting chain and the gripping heads are arranged to grasp the stringers of a pallet. As the chain is winched in, the gripping heads bite into the stringers and pull the pallet in the direction that the chain is being pulled. It is a disadvantage with this arrangement that the gripping heads are easily detached during use if the chain is pulled at an angle. Stop-and-go pulling causes disengagement, resulting in loss of time, and consequently, additional expense. This is particularly the case when pulling of pallets is done by a lone operator of a high-low fork lift unit, who must dismount and mount the unit each time disengagement occurs. Moreover, since the jaws bite into the pallet wood to grasp the pallet, these pallet pullers damage the pallet. Thus, there is a need for a pallet puller arrangement that will not significantly damage the pallet during attachment and use. In addition to the foregoing problems, conventional pallet pullers are heavy (up to about 21 lbs., for example) and expensive to purchase. There is, therefore, a need in the art for a pallet puller arrangement that is economical, lightweight and convenient to carry and store.

It is also well known to construct pallet pullers, inexpensively, from a piece of metal bent in an L-shape. Typically, the L-shaped pallet pullers have an elongated arm having a length sufficient to hook around the rear of a lower deck board of the pallet to be moved. These pallet pullers are, of course, bulky and inconvenient to carry and store. Moreover, turning the pallet is not an option. There is, therefore, a need in the art for a pallet puller arrangement that can easily be attached to the pallet. The L-shaped pallet pullers also suffer from the disadvantage that they can easily become detached during use.

It is further a problem with all known pallet pullers that there is a "slingshot effect" if they become disengaged, or damage the pallet to the point of breaking the stringer or deck wood, or breaking through a joint therebetween. The term "slingshot effect" means that the pallet puller and attached chain whip vigorously in the direction that the chain is being pulled. This can damage the materials on the pallet being moved, or surrounding pallets, as well as cause injury to personnel and property. Thus there is a further need in the art for a pallet puller arrangement that will not easily become dislodged during use.

It is, therefore, an object of this invention to provide a pallet puller arrangement that is economical to manufacture, lightweight, and easy to carry and store.

It is another object of this invention to provide a pallet puller arrangement that is easy to attach to the pallet and is retained in position once attached.

It is also an object of this invention to provide a pallet puller arrangement that does not significantly damage the pallets.

It is additionally an object of this invention to provide a pallet puller arrangement that readily enables a loaded pallet to be rotated so as to be reoriented, and pulled.

It is additionally an object of this invention to provide a pallet puller arrangement that resists bending when a heavily loaded pallet is reoriented or pulled at an angle.

SUMMARY OF THE INVENTION

The foregoing and other objects are achieved by this invention which provides a pallet puller arrangement that interlocks around a stringer and the lead deck board of a pallet or skid. The pallet puller arrangement is adapted to be used in conjunction with a chain and winch mechanism in order to move a pallet in a desired direction. In an apparatus embodiment, the pallet puller arrangement comprises a unitary body having an elongated principal body portion with an aperture at one end thereof. The aperture is suitable for engaging with a chain quick link or any other suitable engagement means to link a chain to the pallet puller arrangement. Distal to the apertured end, the pallet puller arrangement has an engagement portion for coupling around a stringer of a pallet so as to abut a lead, load-bearing cross-member, or deck board, of the pallet.

In a highly advantageous embodiment of the invention, the engagement portion comprises a stringer cradling portion that is generally perpendicular to the elongated body portion and which is provided a flange extending upwardly from the stringer cradling portion in a direction substantially parallel to the elongated body portion. The upwardly extending flange has a protuberance extending beyond a front face of the laterally extending support surface of the stringer cradling portion in a direction toward the aperture. The protuberance, which has a flat bottom portion that is coplanar with the upper surface of the laterally extending support surface of the stringer cradling portion, is adapted to overlie an interior surface of a deck board. The laterally extending support surface is adapted to accommodate the width of the stringer board.

In operation, the pallet stringer is cradled on one side by the elongated body portion over edge thereof by the laterally extending support surface of the stringer cradling portion and on the other side by the flange. Simultaneously, the protuberance is urged by the user to overlie an interior surface of a deck board, thereby securely hooking the pallet puller arrangement to the pallet. As a result of the hooking mechanism, the arrangement of the present invention is much less likely to disengage during use than known arrangements. Moreover, the pallet puller arrangement of the present invention is much less likely to cause damage to a pallet during use.

The pallet puller arrangement should be constructed of strong, yet somewhat pliable or flexible metal. Tempered steel, for example, is too brittle and could break during use resulting in a slingshot effect. In a preferred embodiment, the pallet puller arrangement is constructed of cold rolled steel.

The metal pallet puller arrangement preferably has a protective coating to prevent rust or other degradation. In a preferred embodiment, the pallet puller arrangement is zinc coated. Illustratively, zinc is plated on the metal (e.g., GM spec 4342-M Code 20U32 zinc plate).

In a specific illustrative embodiment, the unitary body of the pallet puller arrangement of the present invention comprises cold rolled steel, illustratively, 1010-1008 C.R.S. that is 0.230 inches thick. In one embodiment, the pallet puller arrangement is 2" wide by 2.125" high by 8.5" length and has a weight of approximately 20 ounces. Thus, the pallet puller arrangement is small enough to be transported in a user's pocket. In this embodiment, the stringer cradling portion is adapted to accommodate the width of typical stringer boards and has a length of 2.25 inches. The protuberance extends 0.50 inches beyond the front face of the cradling portion. It is, of course, to be understood that the dimensions and materials are merely illustrative.

In a further advantageous embodiment of the invention, the engagement portion is formed of a stringer cradling portion that is generally perpendicular to an elongated body portion that is reinforced with a bend, whereby the ability to withstand lateral loading without bending is significantly increased. This embodiment of the invention is particularly suited for rotating heavily loaded pallets, particularly 4-way type stringer pallets. As described hereinabove, this embodiment of the invention is adapted to be used in conjunction with a chain and winch mechanism in order to move a pallet in a desired direction. A unitary body has an elongated principal body portion with an aperture at one end thereof. The aperture is suitable for engaging with a chain quick link connector or any other engagement means suitable to link a chain to this further embodiment of the pallet puller arrangement. In one embodiment, the aperture is disposed on the bend of the elongated body portion. Distal to the apertured end, the pallet puller arrangement has an engagement portion for coupling around a stringer of a pallet so as to abut a lead, load-bearing cross-member, or deck board, of the pallet.

This further embodiment of the invention is provided with a flange extending upwardly from the stringer cradling portion in a direction substantially parallel to the elongated body portion. The upwardly extending flange has a protuberance extending beyond a front face of the laterally extending support surface of the stringer cradling portion in a direction toward the aperture on the end of the elongated principal body portion. The protuberance, which has a flat bottom portion that is substantially coplanar with the upper surface of the laterally extending support surface of the stringer cradling portion is adapted to overlie an interior surface of a deck board. The laterally extending support surface is adapted to accommodate the width of the stringer board.

In view of the increased loading to which this further embodiment of the invention might be subjected during usage, there is a possibility that the stringer cradling portion might wedge between the stringer and the deck board, ultimately being pulled out from therebetween. This disadvantageous operating characteristic is resolved by increasing the effective thickness of the stringer cradling portion. Any of several suitable techniques can be employed to produce such effective an increase in the thickness of the stringer cradling portion, including attachment of an additional layer of metal, or the stamping into the metal of a corrugation or dimple, whereby it is ensured that the pulling forces are delivered to the deck board, and not the juncture of the stringer board and the deck board, illustratively the lower deck board.

In operation, the pallet stringer is cradled on one side by the elongated body portion over edge of the pallet stringer by the laterally extending support surface of the stringer cradling portion and on the other side by the flange. Simultaneously, the protuberance is urged by the user to overlie an interior surface of a deck board, thereby securely hooking the pallet puller arrangement to the pallet. As a result of the hooking mechanism, the arrangement of the present invention is much less likely to disengage during use than known arrangements, and permits the application of a lateral force that facilitates rotational reorientation of the pallet. The pallet puller arrangement of the present invention is much less likely to cause damage to a pallet during use.

As previously noted, the pallet puller arrangement preferably is constructed of cold rolled steel. The bend of the elongated body portion affords sufficient structural rigidity to prevent bending of the elongated body portion during application of lateral forces sufficient to rotate most pallet loads. Of course, the required lateral force will vary from application to application depending upon the loading of the pallet and the characteristics of the friction between the pallet and the surface upon which it is disposed.

In accordance with an apparatus aspect of the invention, a puller device is provided for engaging with a pallet of the type having at least a bottom deck formed of a plurality of substantially parallel spaced-apart slats, each slat being fixed to the slat-coupling side of a stringer that extends substantially orthogonal to the parallel slats. The puller device is provided with a puller portion that has an elongated configuration along an axial direction thereof, with first and second ends distal from one another. An engagement portion is fixed to the first end of the puller portion, the engagement portion having a stringer cradling portion fixed to the first end of the puller portion and extending transverse to the axial direction for communicating with the slat-coupling side of the stringer in the region between the spaced-apart slats, and a coupling protuberance fixed to the stringer cradling portion in a region distal from the puller portion for communicating with a surface of a slat directed toward the slat-coupling side of the stringer. Additionally, there is provided a coupler arrangement disposed on the second end of the puller portion.

In one embodiment of the invention, the puller portion is formed of a channel having an L-shaped cross-sectional configuration. The coupler arrangement is an aperture disposed through the bend of the channel having an L-shaped cross-sectional configuration of the puller portion, in the vicinity of the second end thereof. In another embodiment, the coupler arrangement is formed as an aperture that is disposed through the puller portion in the vicinity of the second end thereof.

In a further embodiment, there is provided a flange that extends from the stringer cradling portion, and which is arranged intermediate of the stringer cradling portion and the coupling protuberance. The puller portion has an elongated flat surface substantially orthogonal to the stringer cradling portion, the flange extending from the stringer cradling portion at a portion thereof distal from, and substantially parallel to, the puller portion. Preferably, the puller portion, the stringer cradling portion, the flange, and the coupling protuberance are integrally formed, illustratively of bent metal.

The coupling protuberance is fixed to the flange in the form of an axial protuberance that extends substantially parallel to the puller portion in the direction of the second end of the puller portion. It is important that the stringer cradling portion have a thickness that precludes the stringer cradling portion from being urged between the stringer and the slat during pulling. This is achieved, in certain embodiments, by providing the stringer cradling portion with a bend in the surface thereof to produce a net thickness that is determined to preclude the stringer cradling portion from being urged between the stringer and the slat during pulling.

In accordance with a further apparatus aspect of the invention, there is provided a puller device for engaging with a pallet of the type having at least a bottom deck formed of a plurality of substantially parallel spaced-apart slats, each slat being fixed to the slat-coupling side of a stringer that extends substantially orthogonal to the parallel slats. A puller portion is provided having an elongated configuration along an axial direction thereof, the puller portion having first and second ends distal from one another. Additionally, an engagement portion is fixed to the first end of the puller portion. The engagement portion has a stringer cradling portion fixed to the first end of the puller portion and extending transverse to the axial direction for communicating with the slat-coupling side of the stringer in the region between the spaced-apart slats; a flange extending from the stringer cradling portion; and a coupling protuberance fixed to the flange and extending substantially toward the second end of the puller portion for communicating with a surface of a slat directed toward the slat-coupling side of the stringer. A coupler arrangement is disposed on the second end of the puller portion.

In accordance with a method aspect of the invention, there is provided a method of repositioning a pallet of the type having at least a bottom deck formed of a plurality of substantially parallel spaced-apart slats, each slat being fixed to the slat-coupling side of a stringer that extends substantially orthogonal to the parallel slats. The method includes the steps of:

- inserting an engagement device over the bottom deck of the pallet along a first side of the stringer,
- cradling the slat-coupling side of the stringer in the region between respective spaced-apart slats;
- engaging with the engagement device a stringer-facing surface of a slat; and
- applying a repositioning force to the engagement device.

In on embodiment of this method aspect of the invention, the step of engaging includes the further step of drawing a coupling protuberance of the engagement device over the stringer-facing surface of a proximal slat on a second side of the stringer.

BRIEF DESCRIPTION OF THE DRAWING

Comprehension of the invention is facilitated by reading the following detailed description, in conjunction with the annexed drawing, in which.

DETAILED DESCRIPTION

Figure 1:
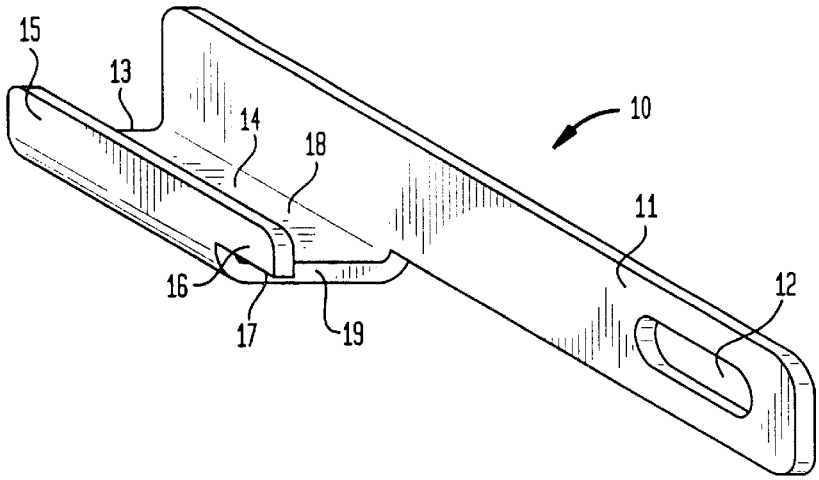
FIG. 1 is an isometric representation of pallet puller arrangement in accordance with the present invention.

FIG. 1 is an isometric representation of pallet puller arrangement 10 in accordance with the present invention. Pallet puller arrangement 10 has an elongated principal body portion 11 with an aperture 12 at one end thereof for engaging with a chain or chain engagement means, such as a clevis hook. Distal to the apertured end, there is an engagement portion 13 for coupling around a stringer of a pallet so as to abut a lead, load-bearing cross-member, or deck slat, of the pallet. In a highly advantageous embodiment of the invention, the engagement portion 13 comprises a stringer cradling portion 14 that is generally perpendicular to the elongated body portion 11 which is provided a flange 15 extending upwardly from the stringer cradling portion in a direction substantially parallel to elongated body portion 11. This upwardly extending flange has a protuberance 16 extending beyond a front face 19 of cradling portion 14 in a direction toward aperture 12. Protuberance 16 has a flat bottom portion 17 that is coplanar with the laterally extending upper support surface 18 of stringer cradling portion 14.

Figure 2:
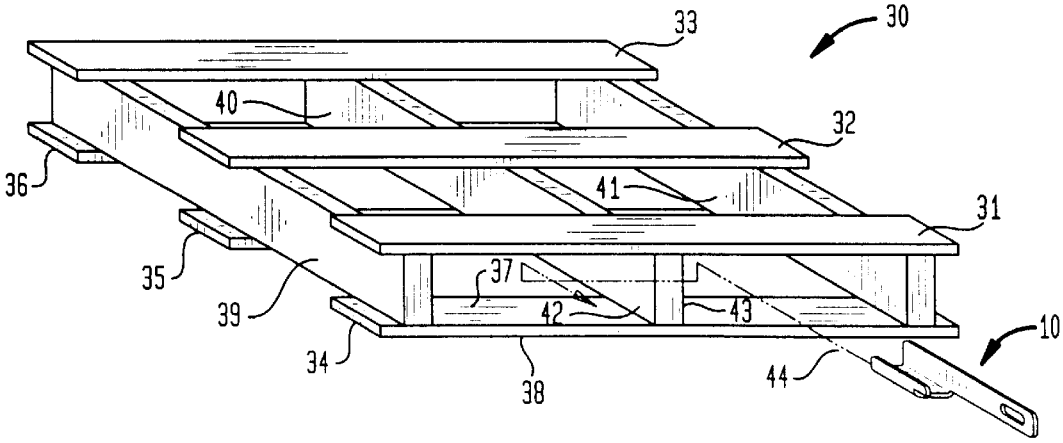
FIG. 2 is an isometric representation of a two-way stringer pallet and pallet puller arrangement 10.

FIG. 2 is an isometric representation of a two-way stringer pallet and pallet puller arrangement 10. As shown, pallet 20 comprises a multiplicity of upper deck boards 31, 32, and 33 and lower deck boards 34, 35, and 36. Boards 31 and 34, for example, are lead deck boards. Lower lead deck board 34 has a top surface 37 and a bottom surface 38. Stringers 39, 40 and 41 run perpendicular to, and separate, the upper and lower deck boards. The narrow edges of the stringer abut a bottom surface of the upper deck boards and the top surface of the lower deck boards. Although pallet puller arrangement 10 can be attached to the pallet in a number of places, for purposes of illustration, pallet puller arrangement 10 is shown attached to pallet 30 at center stringer 40. Center stringer 40 has a left surface 42 and a right surface 43. In operation, pallet puller arrangement 10 is placed around stringer 40 in the direction of arrows 44.

Figure 3:
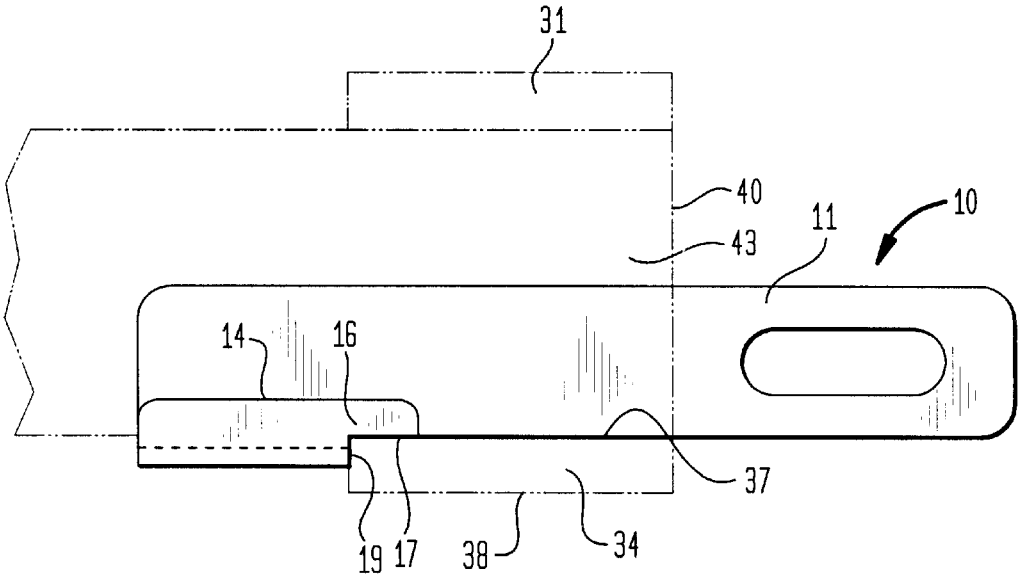
FIG. 3 is a side plan representation of the pallet puller arrangement of the present invention in operation wherein the pallet stringer and deck boards are shown in phantom.
Figure 4:
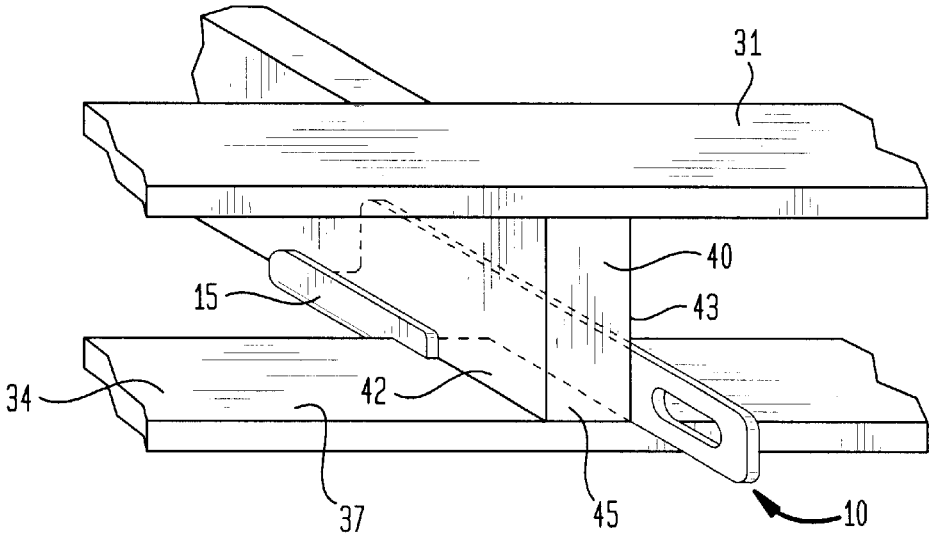
FIG. 4 is an isometric representation of pallet stringer and deck boards wherein the pallet puller arrangement is shown partially in phantom.

The mechanism of attachment is more clearly seen in FIGS. 3 and 4. FIG. 3 is a side plan representation of the pallet puller arrangement of the present invention wherein common elements of structure are indicated by the same reference numerals as in FIGS. 1 and 2. A stringer 40 and attached upper deck board 31 and lower deck board 34 are shown in phantom. In FIG. 4, which is an isometric representation of stringer 40 and lead deck boards 31 and 34, pallet puller arrangement 10 is shown partially in phantom.

In operation, pallet puller arrangement 10 is attached to a stringer as shown and pallet stringer 40 is held within stringer cradling portion 14. Right surface 43 of stringer 40 abuts the elongated body portion 11 of the pallet puller arrangement. The perpendicularly extending upper surface 18 of stringer cradling portion 14 extends under lower edge 45 of stringer 40 and upwardly extending flange 15 abuts left surface 42 of stringer 40. The width of stringer cradling portion 14 is adapted to accommodate the width of standard pallet stringer boards, for example. Simultaneously, protuberance 16 is urged by the user so as to overlie upper surface 37 of lower lead deck board 34. Flat bottom portion 17 of protuberance 16 abuts upper surface 37. In a practical embodiment, protuberance 16 extends at least about 0.5 inches beyond front face 19 of stringer cradling portion 14. In this manner, pallet puller arrangement 10 is securely attached to stringer 40.

Of course, the pallet puller arrangement of the present invention can be inverted to engage the lead board of the upper deck. In this regard, the pallet puller arrangement can be used to move skids.

Referring to FIG. 2, it is obvious that in a standard two-way stringer pallet, there are at least six places on each end of a pallet to which the pallet puller arrangement of the present invention can be attached. Therefore, it is easy to attach and use multiple pallet pullers.

Test Results

A pallet puller arrangement in accordance with FIG. 1 of the present invention was used to pull a new two-way stringer pallet (30" by 30") containing 3200 lbs of steel across a cement floor with no signs of stress or wear to the pallet.

In a second test trial, 5000 lbs of steel was placed on the pallet, the pallet puller arrangement slid between and through the joining area of the stringer board and the lower deck slat, pulling the nails forward, parallel to the floor. However, the stringer board and the lower deck were left in place. This type of damage to a pallet can be easily repaired versus the type of damage resulting from grasping or breaking the pallet wood. Furthermore, there was no "slingshot effect" after the pallet hook pulled through the pallet boards; instead, the pallet hook and chain continued forward at the same speed and direction as before.

Figure 5:
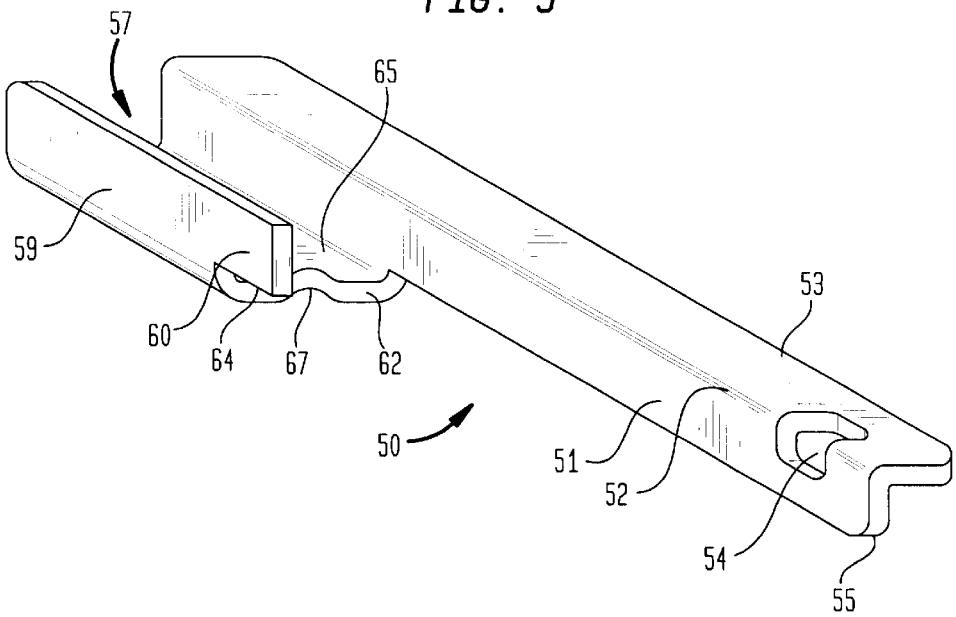
FIG. 5 is an isometric representation of further pallet puller arrangement in accordance with the present invention.

FIG. 5 is an isometric representation of further pallet puller arrangement 50 in accordance with the present invention. As shown in this figure pallet puller arrangement 50 has an elongated body portion 51 that in this specific illustrative embodiment of the invention has a bend 52 therealong to form an orthogonal portion 53 of elongated body portion 51. An aperture 54 is provided in this embodiment on bend 52 of elongated body portion 51. The elongated body portion is configured with a curved end contour 55 to reduce the likelihood that a chain (not shown) or clevis hook would bind thereon during use.

At the distal end of pallet puller arrangement 50, there is provided a stringer cradling portion 57 that is generally perpendicular to elongated body portion 51. On the other side of stringer cradling portion 57 from elongated body portion 51 there is provided a flange 59 extending upwardly from the stringer cradling portion in a direction substantially parallel to elongated body portion 51. This upwardly extending flange has a protuberance 60 extending beyond a front face 62 of cradling portion 57 in a direction toward aperture 54. Protuberance 60 has a flat bottom portion 64 that is substantially coplanar with a laterally extending upper support surface 65 of stringer cradling portion 57.

As previously stated, there is a possibility that front face 62 of stringer cradling portion 57 might wedge between the stringer and the deck board (not shown in this figure), ultimately being pulled out from therebetween. This disadvantageous operating characteristic is resolved by increasing the effective thickness of the front face of the stringer cradling portion, to ensure that the pulling forces are delivered to the deck board, and not the juncture of the stringer board and the deck board, illustratively the lower deck board. In some embodiments, an increase in the thickness of the front face of the stringer cradling portion may include attachment of an additional layer of metal (not shown), or the welding thereon of a stand-off piece (not shown) that would produce the same effect. In the present specific illustrative embodiment of the invention, however, a dimple 67 is stamped into the metal of stringer cradling portion 57. The effective increase in the thickness of front face 62 of cradling portion 57 ensures that the pulling forces are delivered to the deck board, as will be described in greater detail hereinbelow.

Figure 6:
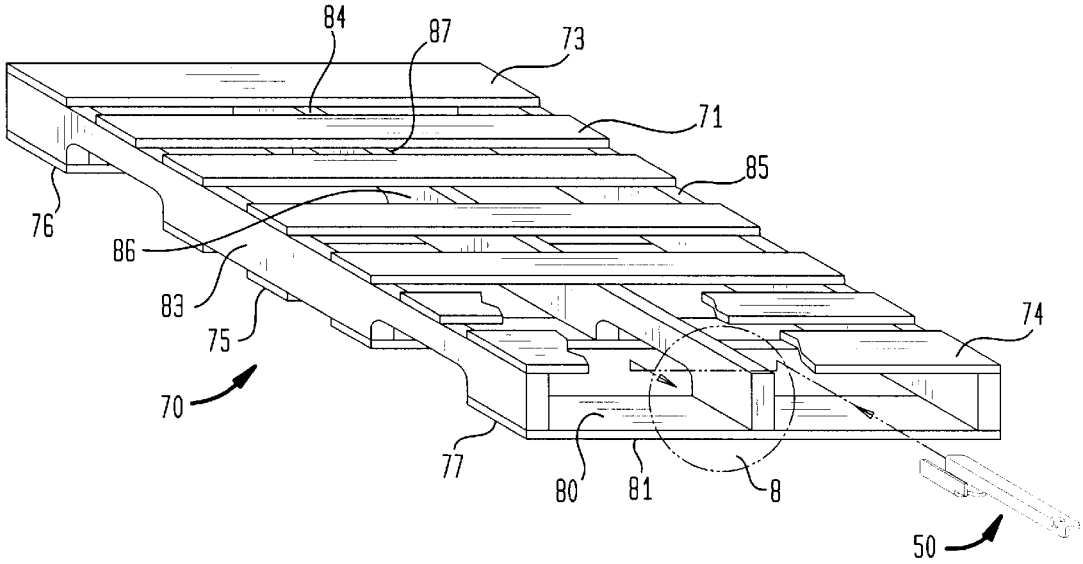
FIG. 6 is an isometric representation of a four-way stringer pallet and pallet puller arrangement 70.

FIG. 6 is an isometric representation of a convention four-way stringer pallet 70, further showing pallet puller arrangement 50. As shown, four-way stringer pallet 70 is formed of a plurality of upper deck boards 71 arranged intermediate of upper deck end boards 73 and 74. The underside of four-way stringer pallet 70 is, in this embodiment, structurally symmetrical to the upper side, having a plurality of lower deck boards 75 arranged intermediate of lower deck end boards 76 and 77. Lower lead deck board 77 has a top surface 80 and a bottom surface 81. Stringers 83, 84, and 85 run perpendicular to, and function to separate, the upper and lower deck boards. The narrow edges of the stringer abut bottom surfaces of the upper deck boards and the top surface of the lower deck boards. Although pallet puller arrangement 50 can be attached to the pallet in a number of places, for purposes of illustration, the pallet puller arrangement is shown attached to pallet 70 at center stringer 84. Center stringer 84 has a left surface 86 and a right surface 87, which is indicated but is not directly visible in this figure. In operation, pallet puller arrangement 50 is placed around stringer 84, as will be described hereinbelow in connection with FIGS. 7 and 8.

Figure 7:
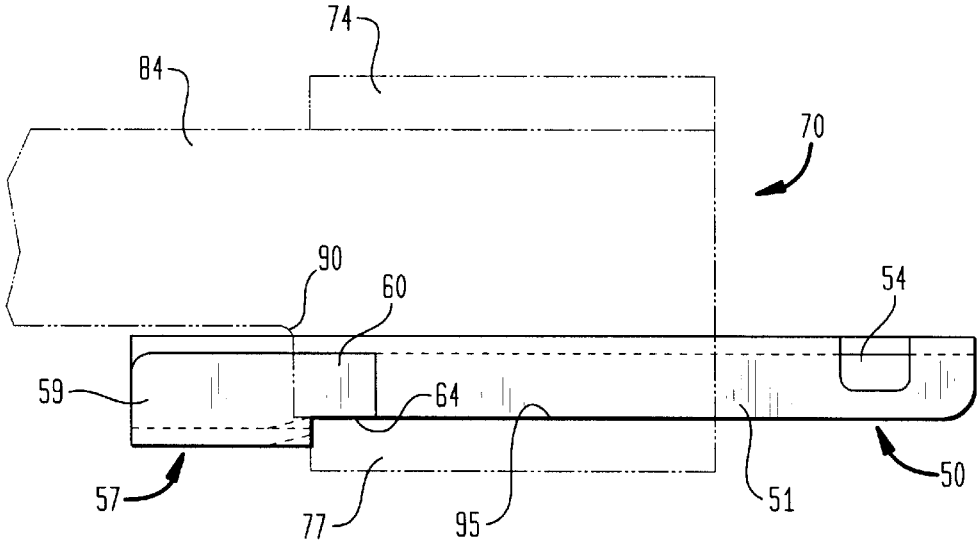
FIG. 7 is a side plan representation of the further pallet puller arrangement of FIG. 5 in operation wherein the pallet stringer and deck boards are shown in phantom.

FIG. 7 is a partially phantom side plan representation further showing pallet puller arrangement 50 of FIG. 5 in operation wherein pallet stringer 84 and end deck boards 74 and 77 are shown in phantom. Elements of structure that previously has been discussed are similarly designated. In this figure, stringer 84 is shown to be coupled at the top thereof to upper deck board 74, and at the bottom thereof to lower deck board 77.

Figure 8:
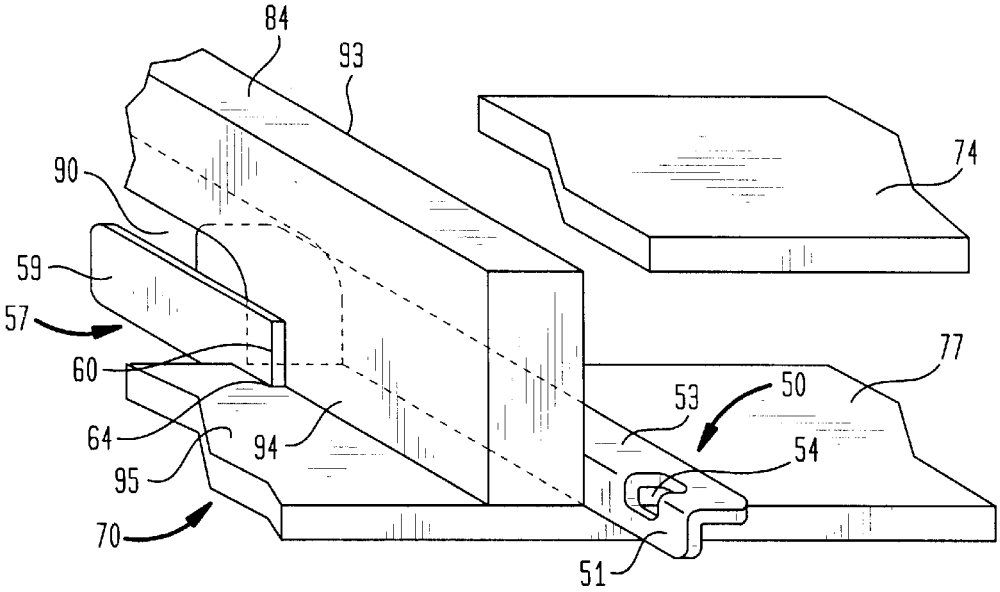
FIG. 8 is an enlarged isometric representation of the pallet stringer and deck boards of region 8 of FIG. 6, wherein the pallet puller arrangement of FIG. 5 is shown partially in phantom.

FIG. 8 is an enlarged isometric representation of the pallet stringer and deck boards of region 8 of FIG. 6, wherein pallet puller arrangement 50 of FIG. 5 is shown partially in phantom. Again, elements of structure that previously has been discussed are similarly designated. Referring to FIGS. 7 and 8, stringer 84 is shown to have in its lower portion a cutout 90 that serves to accommodate the tine of a fork lift unit (not shown), that would engage four-way stringer pallet 70 from directions orthogonal to the longitudinal direction of stringers 83, 84, and 85, i.e., parallel to the longitudinal direction of the deck boards.

In operation, pallet puller arrangement 50 is attached to stringer 84 as shown, wherein a lower portion of the stringer is cradled within stringer cradling portion 57. Right surface 93 (not shown) of stringer 84 abuts the elongated body portion 51 of the pallet puller arrangement. The perpendicularly extending upper surface 65 of stringer cradling portion 57 extends under the lower edge of stringer 84, and upwardly extending flange 59 abuts left surface 94 of stringer 84. The width of stringer cradling portion 57 is adapted to accommodate the width of standard pallet stringer boards. Simultaneously, protuberance 60 is urged by the user so as to overlie upper surface 95 of lower end deck board 77. Flat bottom portion 64 of protuberance 60 abuts upper surface 95 of lower end deck board 77.

In a practical embodiment of four-way stringer pallet 70, protuberance 16 extends approximately about 0.5 inches beyond front face 62 of stringer cradling portion 57. In this manner, pallet puller arrangement 50 is securely attached to stringer 84. Of course, the pallet puller arrangement of the present invention can be inverted to engage upper end deck board 74. In this regard, the pallet puller arrangement can be used to move skids. There are at least six places on each end of a four-way stringer pallet to which the further pallet puller arrangement of the present invention can be attached. Therefore, it is easy to attach and use multiple pallet pullers.

Figure 9:
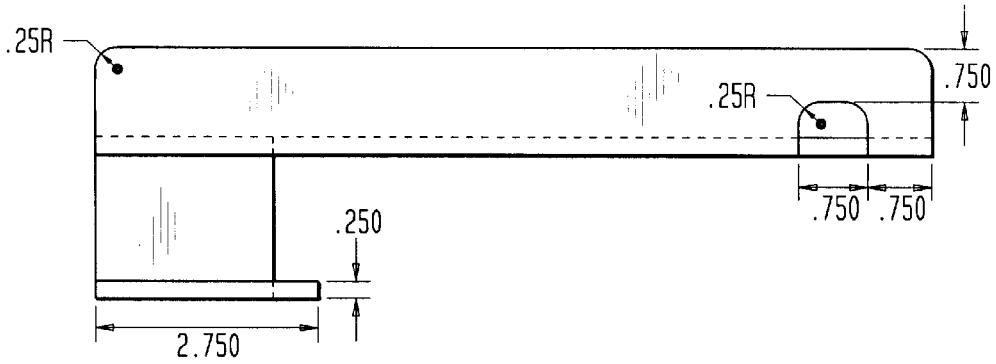
FIG. 9 is a top plan representation of the pallet puller arrangement of FIG. 5 showing illustrative dimensions therefor.
Figure 10:
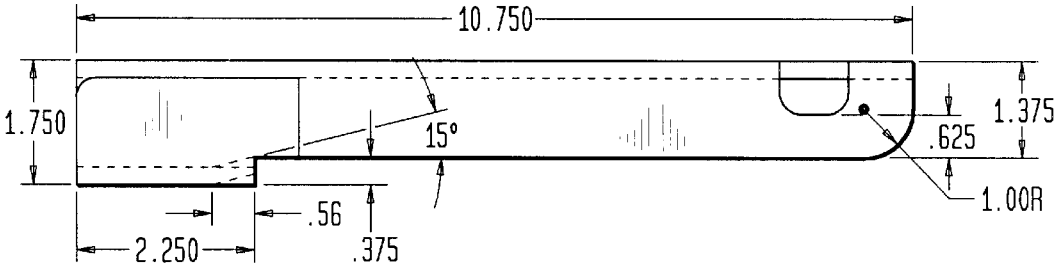
FIG. 10 is a side representation of the pallet puller arrangement of FIG. 5 showing additional illustrative dimensions therefor.
Figure 11:
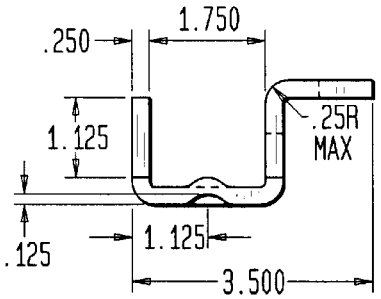
FIG. 11 is an end representation of the pallet puller arrangement of FIG. 5 showing additional illustrative dimensions therefor.

In a specific illustrative embodiment of the invention, pallet puller arrangement 50 can be configured to have the dimensions shown in FIGS. 9–11, wherein FIG. 9 is atop plan representation of the pallet puller arrangement of FIG. 5 showing illustrative dimensions therefor; FIG. 10 is a side representation of the pallet puller arrangement of FIG. 5 showing additional illustrative dimensions therefor; and FIG. 11 is an end representation of the pallet puller arrangement of FIG. 5 showing additional illustrative dimensions therefor. The general overall dimensions of this specific illustrative embodiment of the invention are 10.75" length× 3.5" width×1.75" height.

Test Results

A new four-way stringer pallet (48"×40") loaded with 4583 lbs. of steel coil was turned 90° and pulled across a smooth painted cement floor in one continuous pull. A straight pull was made of the four-way stringer pallet loaded with 5781 lbs. of steel coil. These pulls were performed using two 5/16" quick link chain connectors to one pallet puller. The typical maximum load weight for a four-way stringer pallet (i.e., a GMA pallet) is 3200 lbs.

After the heavy test pulls were completed, the four-way stringer pallet was examined and the only signs of stress were a 0.030" impression where the pallet puller contacted the lower deck board edge and an impression on the underside of the stringer resulting from the cradle bump. No signs of wear or stress were present on the pallet puller.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A puller device for engaging with a pallet of the type having at least a bottom deck formed of a plurality of substantially parallel spaced-apart slats, each slat being fixed to the slat-coupling side of a stringer that extends substantially orthogonal to the parallel slats, the puller device comprising:

a puller portion having an elongated configuration along an axial direction thereof, said puller portion having first and second ends distal from one another;

an engagement portion fixed to the first end of said puller portion, said engagement portion having:

a stringer cradling portion fixed to the first end of said puller portion and extending transverse to the axial direction for communicating with the slat-coupling side of the stringer in the region between the spaced-apart slats; and a coupling protuberance fixed to said stringer cradling portion in a region distal from said puller portion for communicating with a surface of a slat directed toward the slat-coupling side of the stringer; and a coupler arrangement disposed on the second end of said puller portion.

2. The puller device of claim 1, wherein said puller portion is formed of a channel having an L-shaped cross-sectional configuration.

3. The puller device of claim 2, wherein said coupler arrangement comprises an aperture disposed through the bend of the channel having an L-shaped cross-sectional configuration of said puller portion, in the vicinity of the second end thereof.

4. The puller device of claim 1, wherein said coupler arrangement comprises an aperture disposed through said puller portion in the vicinity of the second end thereof.

5. The puller device of claim 1, wherein there is further provided a flange extending from said stringer cradling portion, and arranged intermediate of said stringer cradling portion and said coupling protuberance.

6. The puller device of claim 5, wherein said puller portion has an elongated flat surface substantially orthogonal to said stringer cradling portion, said flange extending from said stringer cradling portion at a portion thereof distal from, and substantially parallel to, said puller portion.

7. The puller device of claim 5, wherein said puller portion, said stringer cradling portion, said flange, and said coupling protuberance are integrally formed.

8. The puller device of claim 7, wherein said puller portion, said stringer cradling portion, said flange, and said coupling protuberance are formed of bent metal.

9. The puller device of claim 5, wherein said coupling protuberance is fixed to said flange in the form of an axial protuberance extending substantially parallel to said puller portion in the direction of the second end of said puller portion.

10. The puller device of claim 1, wherein said stringer cradling portion has a thickness determined to preclude the stringer cradling portion from being urged between the stringer and the slat during pulling.

11. The puller device of claim 10, wherein said stringer cradling portion has a bend in the surface thereof to produce a net thickness determined to preclude the stringer cradling portion from being urged between the stringer and the slat during pulling.

12. A puller device for engaging with a pallet of the type having at least a bottom deck formed of a plurality of substantially parallel spaced-apart slats, each slat being fixed to the slat-coupling side of a stringer that extends substantially orthogonal to the parallel slats, the puller device comprising:

a puller portion having an elongated configuration along an axial direction thereof, said puller portion having first and second ends distal from one another;

an engagement portion fixed to the first end of said puller portion, said engagement portion having:

a stringer cradling portion fixed to the first end of said puller portion and extending transverse to the axial direction for communicating with the slat-coupling side of the stringer in the region between the spaced-apart slats;

a flange extending from said stringer cradling portion; and a coupling protuberance fixed to said flange and extending substantially toward the second end of said puller portion for communicating with a surface of a slat directed toward the slat-coupling side of the stringer; and a coupler arrangement disposed on the second end of said puller portion.

13. The puller device of claim 12, wherein said puller portion, said stringer cradling portion, said flange, and said coupling protuberance are integrally formed.

14. The puller device of claim 13, wherein said puller portion, said stringer cradling portion, said flange, and said coupling protuberance are formed of bent metal.

15. The puller device of claim 12, wherein said stringer cradling portion has a thickness determined to preclude the stringer cradling portion from being urged between the stringer and the slat during pulling.

16. The puller device of claim 15, wherein said stringer cradling portion has a bend in the surface thereof to produce a net thickness determined to preclude the stringer cradling portion from being urged between the stringer and the slat during pulling.

17. A method of repositioning a pallet of the type having at least a bottom deck formed of a plurality of substantially parallel spaced-apart slats, each slat being fixed to the slat-coupling side of a stringer that extends substantially orthogonal to the parallel slats, the method comprising the steps of:

inserting an engagement device over the bottom deck of the pallet along a first side of the stringer;

cradling the slat-coupling side of the stringer in the region between respective spaced-apart slats;

engaging with the engagement device a stringer-facing surface of a slat by drawing a coupling protuberance of the engagement device over the stinger-facing surface of a proximal slat on a second side of the stringer; and applying a repositioning force to the engagement device.

* * * * *